US006531857B2

(12) United States Patent
Ju

(10) Patent No.: US 6,531,857 B2
(45) Date of Patent: Mar. 11, 2003

(54) LOW VOLTAGE BANDGAP REFERENCE CIRCUIT

(75) Inventor: Peicheng Ju, Berkeley Heights, NJ (US)

(73) Assignee: Agere Systems, Inc., Berkeley Heights, NJ (US)

( * ) Notice: Subject to any disclaimer, the term of this patent is extended or adjusted under 35 U.S.C. 154(b) by 0 days.

(21) Appl. No.: 10/007,913

(22) Filed: Nov. 8, 2001

(65) Prior Publication Data

US 2002/0093325 A1 Jul. 18, 2002

Related U.S. Application Data

(60) Provisional application No. 60/247,367, filed on Nov. 9, 2000.

(51) Int. Cl.[7] ..... G05F 3/16

(52) U.S. Cl. ..... 323/316; 327/538

(58) Field of Search ..... 323/315, 312, 323/313, 314, 316, 278; 327/538

(56) References Cited

U.S. PATENT DOCUMENTS 5,087,831 A * 2/1992 Ten Eyck ..... 323/313
6,016,051 A * 1/2000 Can ..... 323/314
6,037,832 A * 3/2000 Kaminishi ..... 323/312

OTHER PUBLICATIONS

Anne–Johan Annema, Low–Power Bandgap References Featuring DTMOST's , *IEEE Journal of Solid–State Circuits*, vol. 34, No. 7, pp. 949–955, Jul. 1999.
Hironori Banba, et al., "A CMOS Bandgap Reference Circuit with Sub–1–V Operation", *IEEE Journal of Solid–State Circuits*, vol. 34, No. 5, pp. 670–673, May 1999.
Harry Neuteboom et al., "A DSP–Based Hearing Instrument IC", *IEEE Journal of Solid Circuits*, vol. 32, No. 11, pp. 1790–1806., Nov. 1997.
Klaas Bult, et al., "A Fast–Settling CMOS Op Amp for SC Circuits with 90–dB DC Gain", *IEEE Journal of Solid State Circuits*, vol. 25, No. 6, pp. 1379–1384, Dec. 1990.

* cited by examiner

*Primary Examiner*—Shawn Riley
(74) *Attorney, Agent, or Firm*—Synnestvedt & Lechner LLP

(57) ABSTRACT

A bandgap reference circuit that uses reduced substrate area while requiring relatively low voltage. The circuit may include a bipolar transistor with a resistor electrically connected across the emitter-base of the bipolar transistor. The resistor sums a first current with a second current and also generates a fractional $V_{EB}$. The bandgap reference circuit may have a first current proportional to $V_{EB}$, and a second current proportional to a PTAT current. An impedance booster may be incorporated into the circuit. Also disclosed is a method of regulating a voltage level using embodiments of the bandgap reference circuit.

20 Claims, 4 Drawing Sheets

$$R_{oa} = r_{o1}$$

$$R_{ob} = (g_{m2} r_{o2} + 1)\, r_{o1} + r_{o2}$$

$$R_{oc} = (g_{m2} r_{o2} (A_2 + 1) + 1)\, r_{o1} + r_{o2}$$

LOW VOLTAGE BANDGAP REFERENCE CIRCUIT

This application is based on provisional application having Ser. No. 60/247,367, having a filing date of Nov. 9, 2000, and entitled Bandgap Reference Circuit for $V_{DD}$=0.75 V in a 0. 16 $\mu$m Digital CMOS.

BACKGROUND OF THE INVENTION

As CMOS technologies continue to migrate into deep submicron region, the power supply voltage will likewise scale to below 1.5 V for reliable operation of devices. In various hand-held and/or wireless devices it is advantageous for the supply voltage to be reduced even further to keep power consumption and weight low. As an essential and integral part of more and more very large scale integration circuit systems, a temperature-compensated (or commonly called bandgap) reference circuit that works with supply voltages below 1.5 V is desired.

FIG. 1 shows a simplified diagram of a conventional CMOS bandgap reference circuit. The closed loop of on operational amplifier $A_0$ forces the voltages at nodes PT and Q2E to be equal, resulting in a bandgap reference voltage $$V_{REF} = \frac{R_0}{R_{PT}} \ln(a_E m_2) V_T + V_{EB2},$$

where $a_E$ is the ratio of emitter areas of $Q_1$ over $Q_2$, and $M_2$ is the current ratio, $I_2/I_1$. $V_\tau$=kT/q, the thermal voltage, has a positive temperature coefficient and $V_{EB}$ has a negative temperature coefficient of about −2MV/°C. Satisfying the condition $dV_{REF}/dT=0$ for $T=T_0$ usually results in $V_{RFF}\approx 1.2$ V with $a_E$=8, $M_2$ =1. Allowing some voltage drop across the current sources $M_1$ and $M_2$, the minimum supply voltage will typically be $V_{DD}\geqq 1.5$ V.

The minimum supply voltage required to properly operate this circuit is $V_{DD}\geqq V_{REF}+V_{SD}$ since $V_{REF}>V_{EB2}$. A common technique to lower the minimum $V_{DD}$ is to generate a Proportional To Absolute Temperature ("PTAT") current and a current proportional to $V_{EB}$, and then sum the two currents into a resistor to generate a bandgap voltage that may contain only a fraction of a $V_{EB}$ instead of a whole $V_{EB}$ voltage. This is commonly referred as a fractional $V_{EB}$ bandgap reference.

Bandgap a reference circuits with minimum supply voltages of $V_{DD}\geqq 0.9$ V have been achieved. A first technique results in a bandgap reference voltage $V_{REF}>V_{EB}$, which limits the supply voltage to $V_{DD}\geqq 0.9$ V. A second technique predicted a lowering of supply voltage to $V_{DD}\geqq 0.85$ V, but achieves only $V_{DD}\geqq 2.1$ V due to technology limitations. The second technique requires that two resistors be connected across the emitter-base terminals of two separate PNP transistors to generate a whole $V_{EB}$ current and sum it with a PTAT current. It then forces the resultant current through a third resistor to produce an appropriate bandgap reference voltage. For a given voltage drop, $V_0$, across a resistor having a current, $I_0$, flowing through, the resistance of the resistor is $R_0=V_{EB}/I_0$. Therefore, the total resistance of the two resistors connected across the emitter-base terminals of two separate PNP transistors is $$R_t = 2\frac{V_{EB}}{I_0},$$

whee $I_0$ is the current flowing through each resistor. For example, $I_0$=1 $\mu$A ($10^{-6}$A) and $V_{EB}$=0.7 V results in $R_1$=1, 400,000Ω. In integrated circuit technologies, chip area needed to implement a resistor is directly proportional to the total resistance of the resistor. Therefore, additional resistors or resistances requires additional chip area.

SUMMARY OF THE INVENTION

Embodiments of the invention provide a bandgap reference circuit that may use reduced substrate area compared to prior art bandgap reference circuits, while requiring relatively low voltage. A first embodiment of the invention includes a bipolar transistor with a resistor electrically connected across the emitter-base of the bipolar transistor. The resistor sums a first current with a second current and also generates a fractional $V_{EB}$.

In an illustrative embodiment of the invention the bandgap reference circuit has a first current is proportional to $V_{EB}$, and a second current proportional to a PTAT current.

In a further embodiment of the invention the bandgap reference circuit has an impedance booster.

The present invention also includes a method of regulating a voltage level using embodiments of the bandgap reference circuit.

DESCRIPTION OF THE FIGURES

The invention is best understood from the following detailed description when read with the accompanying drawings.

DETAILED DESCRIPTION OF THE INVENTION

Embodiments of the invention provide a bandgap reference circuit with a supply voltage lower than that of the prior art, and capable of being fabricated using less area than prior art circuits. The area savings is achieved by having a single resistor consisting of at least two segments connected in series across the emitter-base terminals of a PNP transistor to generate a fractional $V_{EB}$ current and also to sum it with a PTAT current to generate a bandgap reference voltage. This is in contrast to prior art circuits that requires two separate PNP transistors to accomplish both of these tasks.

Figure 1:
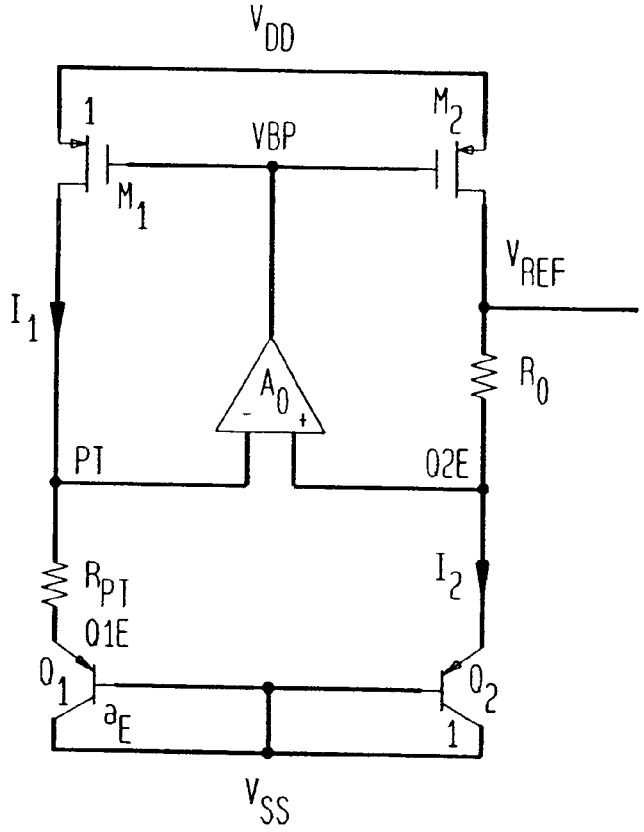
FIG. 1 (PRIOR ART)
FIG. 1 shows a diagram of a prior art CMOS bandgap reference circuit.
Figure 2:
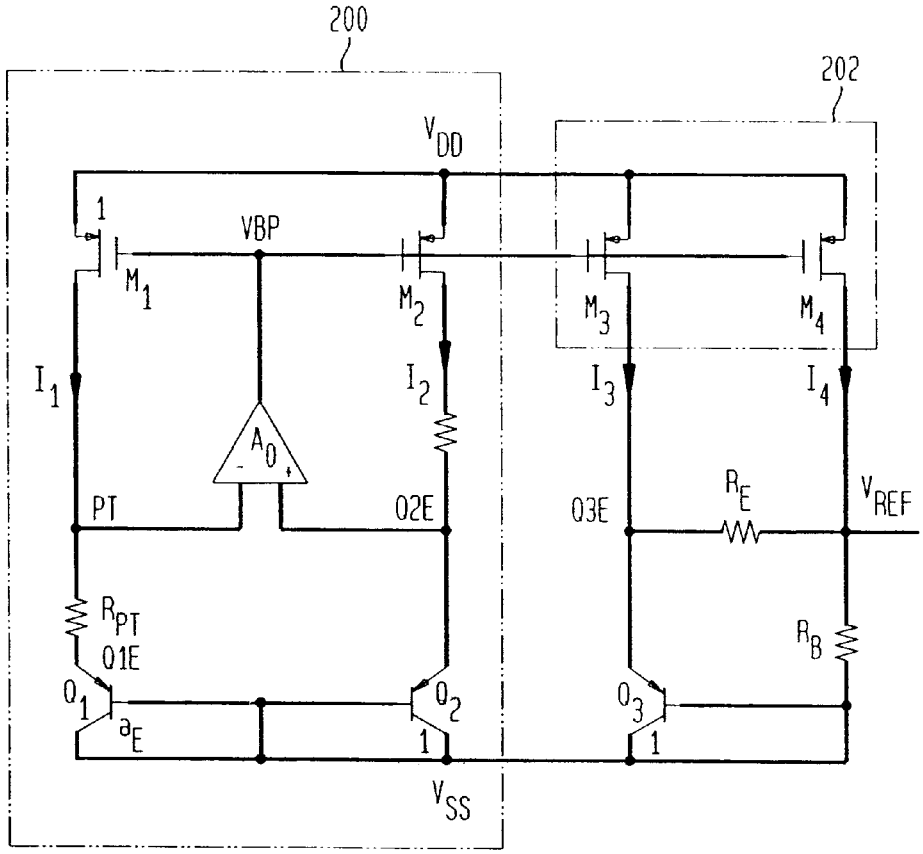
FIG. 2 depicts a CMOS bandgap reference circuits according to an illustrative embodiment of the invention.

FIG. 2 depicts a CMOS bandgap reference circuit using a fractional $V_{BE}$ for low $V_{DD}$ applications according to an illustrative embodiment of the invention. The left hand portion of FIG. 2 represents a bandgap reference circuit 200 which functions in an analogous manner to that which is depicted in FIG. 1. FIG. 2 further depicts circuitry providing a fractional $V_{BE}$ bandgap reference. The circuit may be configured to use less chip area because only one resistor, preferably consisting of two segments, $R_B$ and $R_E$, in series is required to be connected across the emitter-base terminals of a PNP transistor, $Q_3$, and this resistor both generates a fractional $V_{EB}$. current and sums it with a PTAT current to produce a bandgap reference voltage. The total resistance of this resistor is $R_B+R_E$. If current $I_0=1\ \mu A\ (10^{-6}A)$ is required to flow through it, and $V_{EB}=0.7$ V, then the total resistance is $R_t$=7OO,OOO Ω, which is half of the resistance required in prior art circuits without considering the third resistor also needed in the prior circuits. The fractional $V_{EB}$ bandgap reference additionally includes PMOS device $M_3$, the gate of which is connected to the gate of PMOS device $M_4$ and to the gates of PMOS devices $M_1$ and $M_2$. $M_3$ and $M_4$ are commonly referred to as current mirrors of $M_1$ or $M_2$. $M_4$ supplies the PTAT current to the node $V_{REF}$ to be summed with a fractional $V_{EB}$ current by the resistor segment $R_B$, and therefore, the mirroring action must be accurate to guarantee low-sensitivity to temperature variation. $M_3$ only needs to supply sufficient current to node Q3E. The base terminal of the PNP transistor $Q_3$ is connected to $V_{SS}$ as are also the base terminals of $Q_1$ and $Q_2$. The source terminals of PMOS devices $M_1$, $M_2$, $M_3$, and $M_4$ are all connected to the voltage supply node, $V_{DD}$.

The single resistor consisting of two segments $R_E$ and $R_B$in series is connected between the emitter and base terminals of PNP transistor $Q_3$. By injecting a PTAT current, $I_4$, directly into the node $V_{REF}$ the resistors $R_B$ and $R_E$ perform both tasks of the generation of a fractional $V_{EB}$ current and the summation of two currents, with opposite temperature coefficients.

The voltage across $R_B$ is $$V_{REF} = \frac{M_3}{\chi_{BE+1}} \frac{R_B}{R_{PT}} In(a_E m_2) V_T + \frac{\chi_{BE}}{\chi_{BE+1}} V_{BE3},$$

where $X_{BE}=R_B/R_E$ is the resistor ratio. The efficient use of resistors $R_B$ and $R_E$ means only one resistor of a total resistance $(R_B+R_E)$ is connected across a single $V_{EB}$ voltage, as compared to two such configurations in prior art circuits. Considering that the resistance elements usually take up ᵇ ¼ to ⅓ of the area of a bandgap reference circuit in digital CMOS technologies.

The minimum supply voltage for proper operation of the circuit is $V_{DD} \geqq V_{EB}+V_{SD}$ if the $V_{REF}<V_{EB}$ is chosen for the lower portion of the interested temperature range where $V_{EB}$ is large enough by choosing proper values of $X_{BE}$. In order to lower $V_{DD}$ further, one needs to reduce either $V_{EB}$ or $V_{SD}$, or both. Since lowering $V_{EB}$ requires increasing the emitter area and/or lowering $I_{PTAT}$ by increasing $R_{PT}$, the silicon area required increases dramatically because $V_{EB}$ $\ln I_0/A$. Reducing $V_{SD}$ of PMOS transistors that implement the current mirrors runs the risk of increased mismatch among the PTAT currents $I_1$, $I_2$, and $I_4$ because of the decreased output resistance of the current sources. For this reason, the minimum supply voltage for the circuit has been limited at $V_{DD} \geqq 0.85$ V for $V_{EB} \leqq 0.7$ V.

Figure 3A:
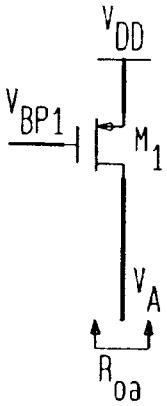
FIGS. 3*a–c* depict illustrative circuit diagrams of a simple current source, a cascoded current source, and a cascoded current source with impedance boosting, respectively, that may be used in embodiments of the invention.
Figure 3B:
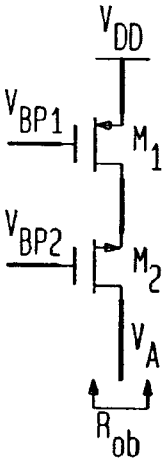
Figure 3C:
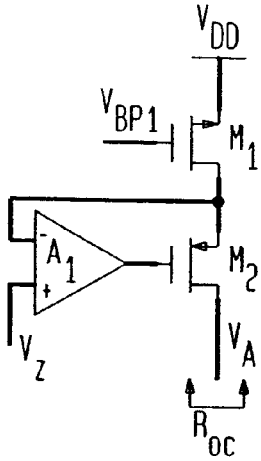

To overcome the mismatch problem in the current sources, an impedance boosting technique may be used. FIGS. 3*a–c* show illustrative circuit diagrams of a simple current source, a cascoded current source, and a cascoded current source with impedance boosting, respectively. The expressions for their output impedances are provided in FIGS. 3a–c as $R_{oa}$, $R_{ob}$ and $R_{oc}$respectively. $V_{BP1}$ and $V_{BP2}$ are bias voltages. In the embodiment depicted in FIG. 3*c*, a gain stage increases the output impedance of the circuit by the gain of the operational amplifier $A_1$, compared to the current source in FIG. 3*b*. For a given output voltage $V_A$. There may be situations of $R_{o1a}>R_{o1b}$, $R_{o2b}$, $R_{o1c}$, $R_{o2c}$, or even $R_{oa}>R_{ob}$. With the additional gain stage $A_1$ inserted as in FIG. 3(*c*), however, $R_{oc}>>R_{ob}$, $R_{oa}$ can be achieved by the gain, $A_1$. This enables the reduction of the total voltage drop across the cascoded current source, and therefore, further lowering of the supply voltage, $V_{DD}$, while still maintaining good matching of the PTAT currents $I_1$, $I_2$, and $I_4$. With $V_{EB2}<0.7$ V, a bandgap reference circuit with a minimum $V_{DD} \geqq 0.75$ V can be designed.

Figure 4:
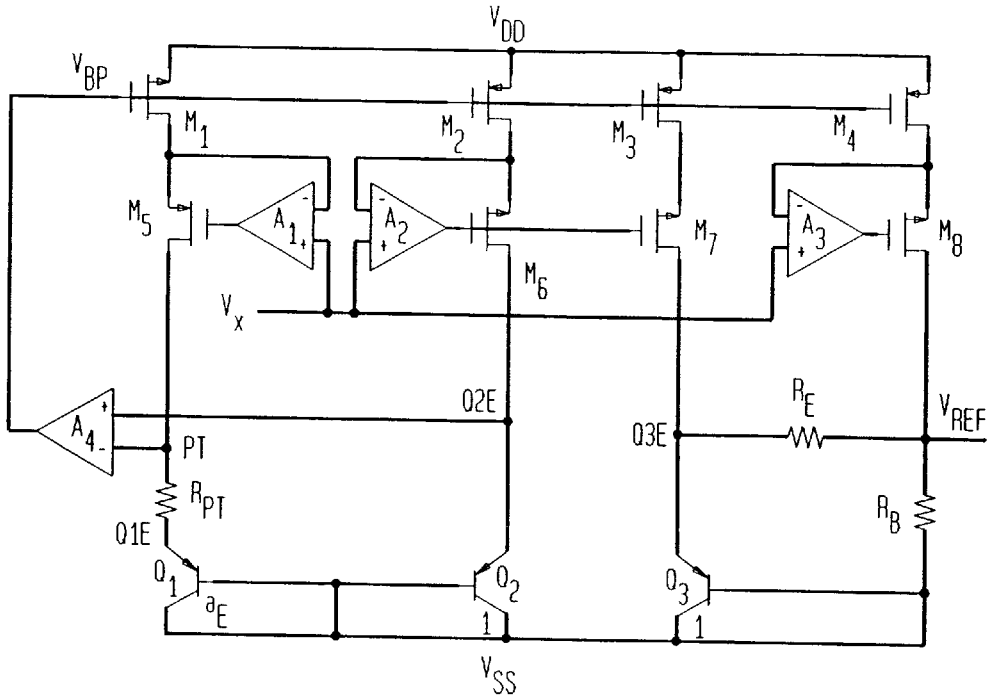
FIG. 4 depicts a circuit with impedance boosting according to an illustrative embodiment of the invention.
Figure 5:
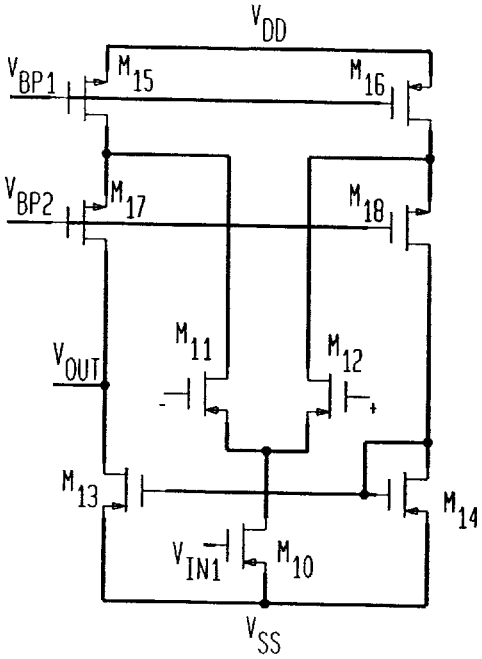
FIG. 5 depicts an illustrative operational amplifier that may be used in an embodiment of the invention.

An illustrative circuit diagram with impedance boosting is shown in FIG. 4 (the start-up circuit is not shown). An illustrative operational amplifier is shown in FIG. 5. There are slight differences between operational amplifiers $A_1$ and $A_2$ due to different gain and offset requirements, but the basic topology may be the same. The folded-cascode operational amplifier topology allows low voltage implementation. In an exemplary embodiment of invention, the bandgap reference circuit and/or the independence booster is implemented in 0.16 μm digital CMOS technology.

The illustrative circuit of FIG. 4 may be described as follows. Voltage supply $V_{DD}$ is connected to sources of CMOS devices $M_1$, $M_2$, $M_3$ and $M_4$. Drains of CMOS devices $M_1$ and $M_2$ are connected to the negative terminals of operational amplifiers $A_1$ and $A_2$, respectively. Outputs of operational amplifiers $A_1$ and $A_2$ are connected to the gates of CMOS devices $M_5$ and $M_6$, respectively. Voltage $V_{BP}$ is connected to the gate of CMOS device $M_1$ and the output of operational amplifier $A_4$. Voltage $V_X$is provided to the positive terminals of operational amplifiers $A_1$, $A_2$ and $A_3$. Drains of CMOS devices $M_5$ and $M_6$ are connected to nodes PT and $Q_{2E}$. respectively. Resistor $R_{PT}$ is connected to the emitter of transistor $Q_1$ and node PT. Voltage $V_{SS}$ is connected to the base of transistors $Q_1$, $Q_2$ and $Q_3$. The non-inverting terminal of operational amplifier $A_4$ is connected to node Q2E, as are also the drain of device $M_6$ and emitter of transistor $Q_2$. A drain of CMOS device $M_3$ is connected to the source of CMOS device $M_7$. The drain of CMOS device $M_7$ is connected to node Q3E, as are also resistor $R_E$ and the emitter of transistor $Q_3$. A node at $V_{REF}$ is connected to resistors $R_E$ and $R_B$, and the drain of CMOS device $M_8$. The gate of CMOS device $M_8$ is connected to the output of operational amplified $A_3$. The negative terminal of operational amplifier $A_3$ is connected to the source of CMOS device $M_8$ and the drain of CMOS device $M_4$. Resistor $R_B$ is further connected to the base of transistor $M_3$.

The operational amplifier circuit diagram of FIG. 5 may be described as follows. Voltage supply $V_{DD}$ is connected to the sources of CMOS devices $M_{15}$ and $M_{16}$. Gates of CMOS devices $M_{15}$ and $M1_{16}$ are connected to one another and further to voltage $V_{BP1}$. Drains of CMOS devices $M_{15}$ and $M_{16}$ are connected to the drains of CMOS devices $M_{11}$ and $M_{12}$. CMOS devices $M_{11}$ and $M_{12}$ have sources connected to one another and further to the source of CMOS device $M_{10}$. Voltage $V_{SS}$ is connected to the sources of CMOS devices $M_{10}$, $M_{13}$ and $M_{14}$. The gate of CMOS device Mio is connected to $V_{2N1}$, $V_{BP2}$ is connected to the gates of CMOS devices $M_{17}$ and $M_{18}$. Voltage $V_{OUT}$ is connected to CMOS devices $M_{17}$ and $M_{13}$.

FIG. 4 shows plots of the measured bandgap voltage vs. temperature for $V_{DD}$=0.75 and 1.0 V. It shows a stable reference voltage at about 0.57 V over a temperature range −45° to 125° C. The resistor ratio, $X_{BE}$=1 and current ratios $m_2=m_4=1$ are chosen. The variation of the reference voltage over the temperature range is 17 mVolts. The power supply rejection is about 20 dB at 100 kHz for $V_{DD}$=0.75 V. Measurements of devices from several wafers have shown quite consistent results.

In an illustrative embodiment of the invention, the bandgap reference circuit has a supply voltage of less than about 0.80 V. More preferably the supply voltage is less than about 0.75 V, and most preferably less than about 0.70 V.

Further embodiments include a method of regulating a voltage level using the techniques and circuits described above.

While the invention has been described by illustrative embodiments, additional advantages and modifications will occur to those skilled in the art. Therefore, the invention in its broader aspects is not limited to specific details shown and described herein. Modifications, for example, to circuit configurations and components, may be made without departing from the spirit and scope of the invention. Accordingly, it is intended that the invention not be limited to the specific illustrative embodiments but be interpreted within the full spirit and scope of the appended claims and their equivalents.

What is claimed is:

1. A bandgap reference circuit comprising:

a bipolar transistor;

a resistor electrically connected across an emitter-base of the bipolar transistor;

wherein the resistor sums a first current with a second current and generates a fractional $V_{EB}$.

2. The bandgap reference of claim 1 wherein the first and second currents have opposite temperature coefficients.

3. The bandgap reference circuit of claim 1 wherein the first current is proportional to $V_{EB}$, and the second current is proportional to a PTAT current.

4. The bandgap reference circuit of claim 1 further comprising an impedance booster.

5. The bandgap reference circuit of claim 4 wherein the impedance booster includes a gain stage.

6. The bandgap reference circuit of claim 1 comprising digital CMOS technology.

7. The bandgap reference circuit of claim 1 wherein the bandgap reference circuit comprises about 0.16 $\mu$m digital CMOS technology.

8. The bandgap reference circuit of claim 1 wherein the bandgap reference circuit operates with a supply voltage of less than about 0.80 V.

9. The bandgap reference circuit of claim 1 wherein the bandgap reference circuit operates with a supply voltage of less than about 0.75 V.

10. The bandgap reference circuit of claim 1 wherein the bandgap reference circuit operates with a supply voltage of less than about 0.70 V.

11. A method of regulating a voltage level comprising:

providing a bipolar transistor;

electrically connecting a resistor across an emitter-base of the bipolar transistor;

summing a first current with a second currents by the resistor; and generating a fractional $V_{EB}$ by the resistor.

12. The method claim 11 wherein the first and second currents have opposite temperature coefficients.

13. The method of claim 11 wherein the first current is proportional to $V_{EB}$, and the second current is proportional to a PTAT current.

14. The method of claim 11 further comprising:

boosting the impedance.

15. The method of claim 14 wherein the impedance is boosted with the use of a gain stage.

16. The method of claim 11 wherein the bandgap reference circuit comprises about 0.16 $\mu$m digital CMOS technology.

17. The method of claim 11 wherein the bandgap reference circuit operates with a supply voltage of less than about 0.80 V.

18. The method of claim 11 wherein the bandgap reference circuit operates with a supply voltage of less than about 0.75 V.

19. The method of claim 11 wherein the bandgap reference circuit operates with a supply voltage of less than about 0.70 V.

20. A semiconductor device comprising a bandgap reference circuit according to claim 1.

* * * * *